US008527155B2

(12) United States Patent
Gudat

(10) Patent No.: US 8,527,155 B2
(45) Date of Patent: Sep. 3, 2013

(54) WORKSITE AVOIDANCE SYSTEM

(75) Inventor: Adam J. Gudat, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 937 days.

(21) Appl. No.: 12/163,652

(22) Filed: Jun. 27, 2008

(65) Prior Publication Data

US 2009/0326734 A1 Dec. 31, 2009

(51) Int. Cl.
*G05D 1/00* (2006.01)
*G08G 1/16* (2006.01)

(52) U.S. Cl.
USPC ..... 701/50

(58) Field of Classification Search
USPC ..... 701/300–302, 50, 1, 23–28; 340/539.26, 340/540, 425.5, 435, 436, 463; 37/413; 299/1.05, 1.9, 95, 12
See application file for complete search history.

(56) References Cited

U.S. PATENT DOCUMENTS

| | | | | |
|---|---|---|---|---|
| 3,625,303 | A | 12/1971 | Cameron | |
| 4,482,960 | A | 11/1984 | Pryor | |
| 5,343,206 | A * | 8/1994 | Ansaldi et al. | 342/70 |
| 5,436,839 | A * | 7/1995 | Dausch et al. | 701/27 |
| 5,646,844 | A | 7/1997 | Gudat et al. | |
| 5,646,845 | A * | 7/1997 | Gudat et al. | 701/41 |
| 6,058,344 | A * | 5/2000 | Rowe et al. | 701/50 |
| 6,201,883 | B1 * | 3/2001 | Mizui | 382/109 |
| 6,247,538 | B1 | 6/2001 | Takeda et al. | |
| 6,336,051 | B1 | 1/2002 | Pangels et al. | |
| 6,363,632 | B1 * | 4/2002 | Stentz et al. | 37/414 |
| 6,539,294 | B1 * | 3/2003 | Kageyama | 701/23 |
| 6,678,590 | B1 | 1/2004 | Burchfiel | |
| 6,728,608 | B2 * | 4/2004 | Ollis et al. | 701/28 |
| 7,272,474 | B1 | 9/2007 | Stentz et al. | |
| 7,574,821 | B2 * | 8/2009 | Furem | 37/348 |
| 7,578,079 | B2 * | 8/2009 | Furem | 37/348 |
| 7,742,853 | B2 * | 6/2010 | Mori et al. | 701/24 |
| 7,865,285 | B2 * | 1/2011 | Price et al. | 701/50 |
| 8,232,888 | B2 * | 7/2012 | Frederick et al. | 340/686.1 |
| 2001/0021888 | A1 * | 9/2001 | Burns et al. | 701/23 |
| 2005/0024492 | A1 | 2/2005 | Schaefer et al. | |
| 2005/0283294 | A1 | 12/2005 | Lehman, Jr. et al. | |
| 2006/0089764 | A1 * | 4/2006 | Filippov et al. | 701/23 |
| 2006/0090378 | A1 * | 5/2006 | Furem | 37/443 |
| 2006/0090379 | A1 * | 5/2006 | Furem | 37/443 |
| 2006/0149472 | A1 | 7/2006 | Han et al. | |
| 2007/0150149 | A1 | 6/2007 | Peterson et al. | |
| 2007/0293996 | A1 * | 12/2007 | Mori et al. | 701/23 |

FOREIGN PATENT DOCUMENTS

| | | |
|---|---|---|
| EP | 0369694 | 5/1990 |
| EP | 1835079 | 9/2007 |
| WO | 2008039598 | 4/2008 |

* cited by examiner

*Primary Examiner* — Khoi Tran
*Assistant Examiner* — Jason Holloway
(74) *Attorney, Agent, or Firm* — Finnegan, Henderson, Farabow, Garrett & Dunner LLP

(57) ABSTRACT

An avoidance system is disclosed for operating a vehicle on a pile of material on a worksite, the material being released through an opening at the worksite and causing a disturbance zone to form on a surface of the pile. The system has a sensor positioned at the worksite and configured to sense the surface of the pile, and a processor in communication with the sensor and the vehicle. The processor is configured to identify the disturbance zone based on the sensed surface and a known location of the opening, and to transmit a signal indicative of the disturbance zone to the vehicle.

20 Claims, 10 Drawing Sheets

WORKSITE AVOIDANCE SYSTEM

TECHNICAL FIELD

The present disclosure relates generally to avoidance systems and, more particularly, to a worksite avoidance system.

BACKGROUND

Worksites, such as, for example, mines, landfills, quarries, excavation sites, etc., commonly have vehicles operating on the worksites' surfaces performing a variety of tasks. For example, at an excavation site, the surface is altered by excavation vehicles and/or other equipment. Due to the nature of worksites, the surfaces can be obstructed by a variety of obstacles, such as, for example, uneven terrain, equipment, vehicles, workers, worksite infrastructure (e.g., buildings), and/or other objects.

Vehicles operating on the worksites need to avoid such obstacles to prevent damage to the vehicles, entering impassible terrain, worker injury, and/or other inconveniences. Obstacle avoidance, however, can be difficult under some circumstances. For example, some vehicles offer poor visibility of the worksite. Other vehicles may be remotely controlled, and the vehicle operator may be relying on a video display of the worksite in controlling the vehicle. The obstacles may be difficult to perceive from the video display and/or left out altogether. Still other vehicles are autonomously controlled (i.e., unmanned), and an operator may not be present to determine whether a particular obstacle should be avoided and/or to control the vehicle to avoid the obstacle.

One system for detecting an obstacle is disclosed by U.S. Pat. No. 7,272,474 to Stentz et al. ("the '474 patent"). The system of the '474 patent divides a terrain surface map into a plurality of terrain cells. The system then determines vehicle control data for the terrain cells along a planned global path of an unmanned vehicle. Specifically, local path segments along the global path are determined to avoid vehicle entry into terrain cells in which a maximum pitch or roll angle is predicted to be exceeded; the minimum ground clearance for a vehicle cannot be maintained; and the suspension limits of the vehicle are predicted to be exceeded.

While the system of the '474 patent may help a vehicle avoid some obstacles, its application may be limited. Some obstacles may not be detectable based only on the terrain surface map. For example, some terrain cells that would not cause the vehicle to exceed a maximum pitch or roll angle nonetheless should not be entered, such as in a case where a feature beneath the surface creates an obstacle not entirely evident on the surface.

This disclosure is directed to overcoming one or more of the problems set forth above.

SUMMARY

One aspect of the disclosure is directed to a method of operating a vehicle on a pile of material on a worksite, the material being released through an opening at the worksite. The method may include sensing a surface of the pile and identifying, based on the sensed surface and a known location of the opening, a disturbance zone on the surface of the pile caused by the release of material. The method may further include transmitting a signal indicative of the disturbance zone to the vehicle.

Another aspect of the disclosure is directed to an avoidance system for operating a vehicle on a pile of material on a worksite, the material being released through an opening at the worksite and causing a disturbance zone to form on a surface of the pile. The system may include a sensor positioned at the worksite and configured to sense the surface of the pile, and a processor in communication with the sensor and the vehicle. The processor may be configured to identify the disturbance zone based on the sensed surface and a known location of the opening, and to transmit a signal indicative of the disturbance zone to the vehicle.

Yet another aspect of the disclosure is directed to a computer-readable storage medium storing a computer program which, when executed by a computer, causes the computer to perform a method of operating a vehicle on a pile of material on a worksite, the material being released through an opening at the worksite. The method may include sensing a surface of the pile and identifying, based on the sensed surface and a known location of the opening, a disturbance zone on the surface of the pile caused by the release of material. The method may further include transmitting a signal indicative of the disturbance zone to the vehicle.

Still yet another aspect of the disclosure is directed to a vehicle operating on a pile of material on a worksite, the material being released through an opening at the worksite. The vehicle may include a communication device configured to receive a signal indicative of a sensed surface of the pile, a positioning device configured to determine of the vehicle on the worksite and to generate a signal indicative of the vehicle's location, and a controller in communication with the positioning device and the communication device. The controller may be configured to identify, based on the sensed surface and a known location of the opening, a disturbance zone on the surface of the pile caused by the release of material, and to determine whether the vehicle is located within a distance of the zone.

DETAILED DESCRIPTION

Figure 1:
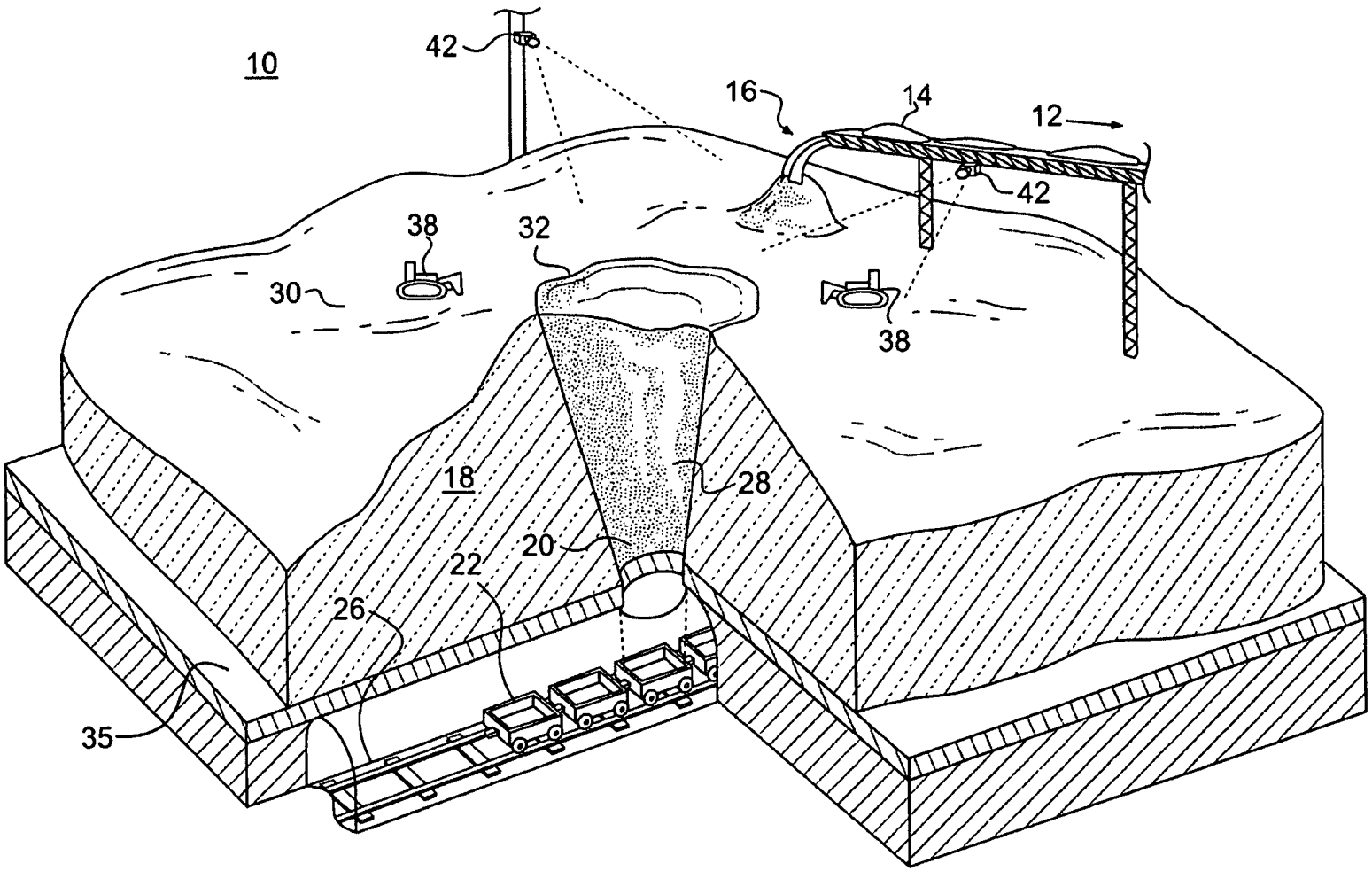
FIG. 1 shows a representation of a worksite having a material workpile thereon.

FIG. 1 illustrates an exemplary disclosed worksite 10. Worksite 10 may represent any material-gathering site at which mined materials, such as coal, sand, rock, gravel, and/or other loose material is collected for transportation to a destination, such as a distributor. For example, coal may be extracted from a mine, or another source 12 of material, and gathered at worksite 10 for transportation to a distributor.

A conveyor 14 and/or other material transport means on worksite 10 may move material 16 extracted from source 12 onto a material workpile 18 on worksite 10. An opening 20 positioned at the bottom of worksite 10, beneath workpile 18, may release (i.e., "drain") material 16 from workpile 18 onto a transport vehicle 22, such as a train, a haul truck. Alternatively or additionally, a conveyor, a ship, and/or another transport means may be used.

In the example shown in FIG. 1, worksite 10 may be part of a material storage facility (not shown), and transport vehicle 22 may be situated in a tunnel 26 passing under worksite 10. It is to be appreciated, however, that worksite 10 may alternatively be a man-made structure (not shown), such as a concrete basin or the like, suitable for collecting large amounts of material 16.

Opening 20 may be positioned with respect to tunnel 26 to allow material 16 to be released onto transport vehicle 22. Opening 20 may include, for example, a valve (not shown) that can be selectively opened and closed to release desired amounts of material 16 onto transport vehicle 22. It is to be appreciated, however, that other suitable configurations for worksite 10 may be implemented.

The draining of material 16 through opening 20 may cause a draw-down funnel 28, extending vertically through workpile 18 between opening 20 and a workpile surface 30 of workpile 18, to form within workpile 18. Material 16 within funnel 28 may be pulled by gravity toward opening 20, creating a disturbance zone 32 on workpile surface 30 into which material 16 enters funnel 28. That is, funnel 28 may define a mobile region of workpile 18 in which material 16 falls toward opening 20. Funnel 28 may be a naturally-occurring phenomenon in workpile 18 caused by the release of material 16, rather than being caused by a structure or the like in workpile 18.

Figure 2:
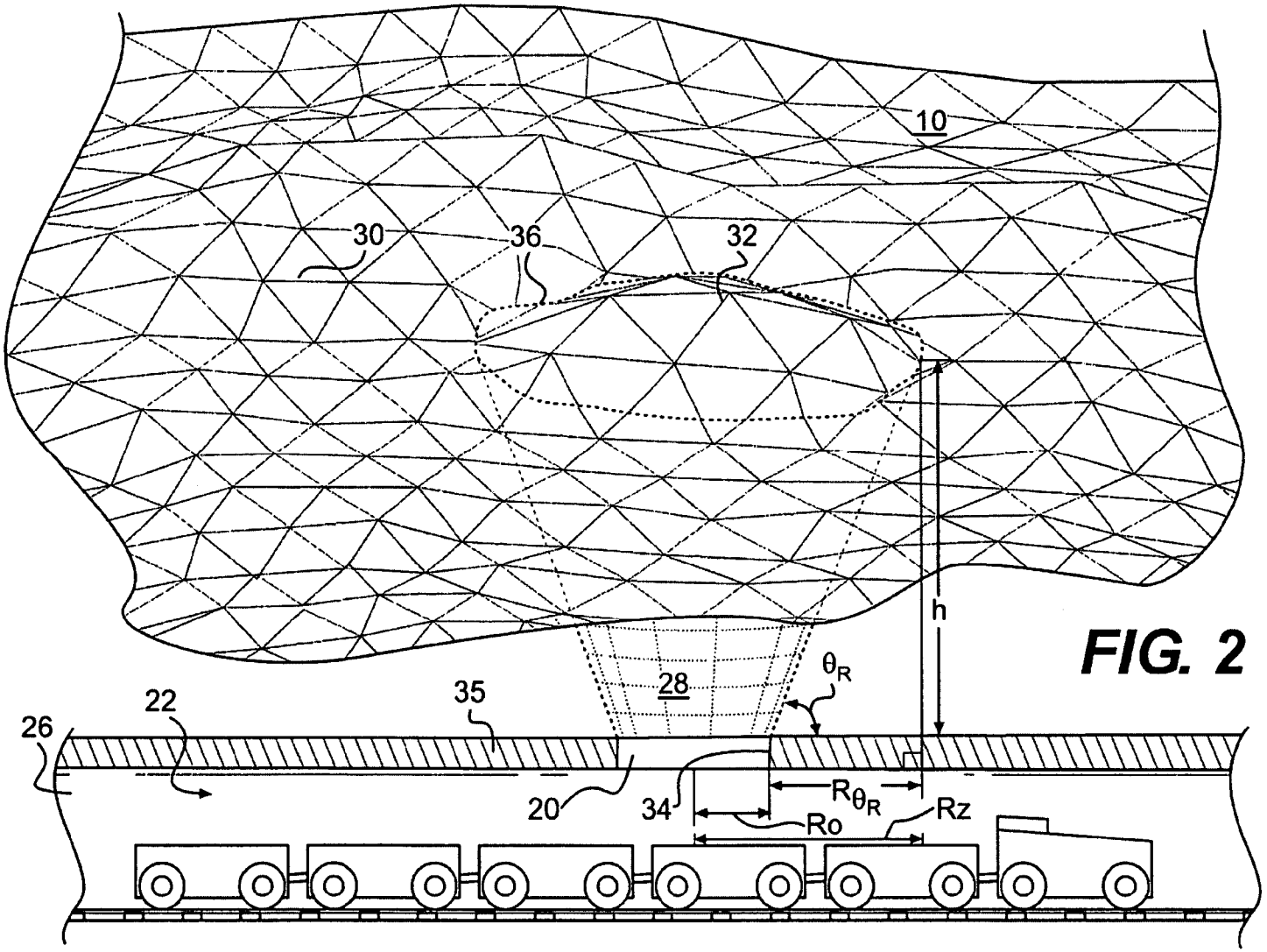
FIG. 2 shows a representation of a funnel that may form within the workpile of FIG. 1.

FIG. 2 shows a detailed view of funnel 28. Due to the nature of material 16, funnel 28 may emanate from a perimeter 34 of opening 20 at an angle of repose $\theta_R$ of material 16 with respect to a bottom surface 35 of worksite 10. As such, funnel 28 may have a generally conical shape. Thus, if workpile 18 (FIG. 1) were left unattended for a sufficient amount of time, and enough material 16 were released through opening 20, a conically-shaped void having a slope equal to angle of repose $\theta_R$ of material 16 would form in workpile 18.

Angle of repose $\theta_R$ may be defined as the maximum stable angle at which material 16 may sit on a horizontal surface (i.e., a horizontal surface defined by bottom 35 of worksite 10), without collapsing due to the pull of gravity. Angle of repose $\theta_R$ may depend upon the coefficient of friction of material 16, the cohesion of material 16, the particulate shape of material 16, the density of material 16, the moisture content of material 16, the temperature of material 16, environmental conditions (e.g., humidity), and/or other factors. In one example, coal has been found to have an angle of repose of about 60 degrees. It is to be appreciated however, that the angle of repose may vary with the type of material and/or any of the factors mentioned above.

As shown by FIG. 2, the radius Rz of zone 32 may vary with the height h of workpile surface 30. The radius Rz of zone 32 may be equal to a radius Ro of opening 20 plus an additional radial distance $R\theta_R$ due to angle of repose $\theta_R$:

$$R_Z = R\theta_R + R_o, \tag{1}$$

where Rz is the radius of zone 32, $R\theta_R$ is the radial distance due to angle of repose $\theta_R$ of material 16, and Ro is the radius of opening 20.

Thus, the radius Rz of zone 32 may be defined as:

$$R_Z = \frac{h}{\tan(\theta_R)} + R_o, \tag{2}$$

where h is the height of funnel 28 (i.e., the height h of workpile surface 30 above bottom 35); $\theta_R$ is the angle of repose of material 16 (i.e., the angle at which funnel 28 emanates from perimeter 34 of opening 20; and Ro is the radius of opening 20. It is to be appreciated that zone Rz (and size) may therefore vary with workpile height h. Consequently, a location of a zone perimeter 36 may change with time, as workpile height h changes. Further, because the workpile height h may vary from point to point on workpile surface 30, zone radius Rz and, thus, the location of zone perimeter 36 may also vary at different locations on workpile surface 30. For instance, if workpile surface 30 is substantially uneven, zone 32 may have a cross-sectional shape different than that of opening 20 (e.g., non-circular).

Zone 32 may therefore have a dynamic, shifting nature, and the size and shape of zone 32 may vary as conditions on worksite 10 change. For example, the size and shape of zone 32 may change as additional material 16 is delivered to workpile 18 and workpile height h increases; as material 16 is released onto transport vehicle 22 and workpile height h decreases; and/or as material 16 is shifted about workpile 18 and workpile height h changes in or near zone 32 (e.g., along zone perimeter 36).

Further, while opening 20 is discussed above as having a circular shape (i.e., as having a radius), it is to be appreciated that the same principles may apply even if non-circular shapes are employed. For example, opening 20 may alternatively have a rectangular shape. In such a case, zone 32 may also have a rectangular shape, albeit larger and rounded off, and funnel 28 may therefore have a rounded, rectangular conical shape. The location of zone perimeter 36, however, may similarly be defined based on the location of perimeter 34 of opening 20, angle of repose $\theta_R$, and workpile height h.

Turning back to FIG. 1, vehicles 38, such as dozers and/or other equipment, and workers (not shown) may continually move material 16 about worksite 10 and into zone 32 as material 16 is released through opening 20, to efficiently load material 16 onto transport vehicle 22. Due to the mobile nature of material 16 within zone 32 (and within funnel 28), however, footing and/or traction within zone 32 may be poor. That is, material 16 inside zone 32 may be unstable, rendering traversal of zone 32 difficult and/or unsafe. Thus, while it may be advantageous to periodically move material 16 into zone 32 to maintain an even workpile 18 and to load transport vehicle 22 efficiently, it may also be desirable to, at the same time, keep vehicles 38, workers, and/or other objects outside of zone 32 (i.e., outside zone perimeter 36). For example, due to the unstable footing within zone 32, vehicles 38 could become trapped if vehicles 38 enter zone 32.

Workers and vehicle operators may sometimes visually observe shifts of material 16 in workpile 18, and thereby detect and avoid zone 32. However, the slope of workpile surface 30 within zone 32 may at times be relatively flat, rendering zone 32 inconspicuous. This may make it difficult for the workers and vehicle operators to visually observe and avoid zone 32. Further, depending upon the type of material 16, workpile surface 30 can temporarily solidify, or "crust over." Such "crusting" can occur, for example, in coal stock piles. Additionally, because the workpile height h can change over time and or differ from location to location on workpile surface 30, the shape of zone 32 may be dynamic and/or irregular. These factors, among others, may further render accurate visual detection and avoidance of zone 32 by workers and vehicle operators difficult.

Figure 3:
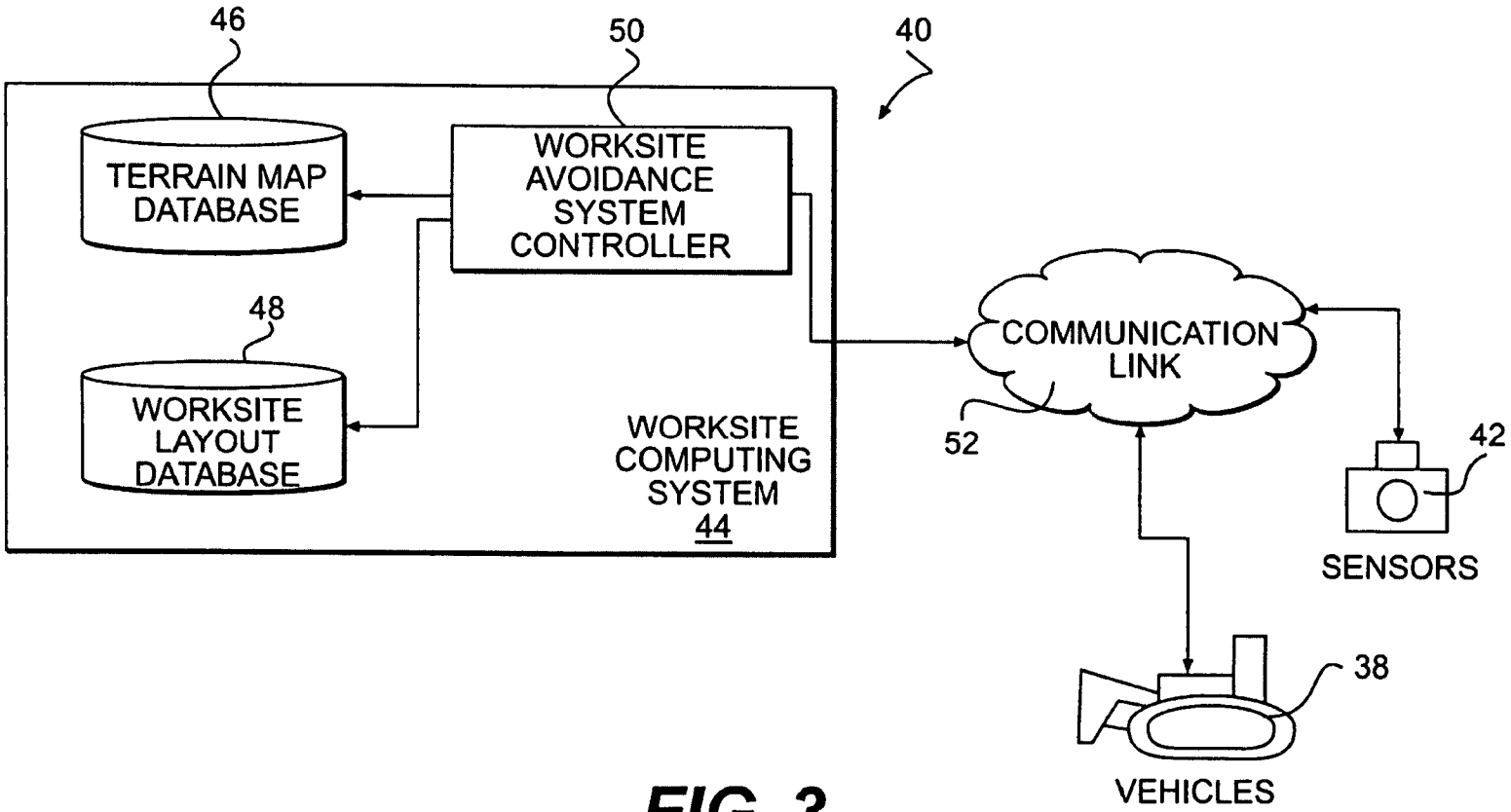
FIG. 3 shows a representation of a worksite avoidance system for use with the worksite of FIG. 1.

FIG. 3 shows a disclosed worksite avoidance system 40. Worksite avoidance system 40 may dynamically map workpile surface 30 to identify the presence, size, shape, and/or other features of zone 32, while vehicles 38 and/or workers move material 16 about workpile 16. Worksite avoidance system 40 may determine whether vehicles 38 travel within a certain distance of, or into, zone 32, and send an alert signal to vehicles 38. Worksite avoidance system 40 may also transmit signals containing information about workpile surface 30 and/or zone 32 to vehicles during vehicle operation. These features will be discussed in further detail below.

Worksite avoidance system 40 may include sensors 42 and vehicles in communication with a worksite computing system 44. Worksite computing system 44 may be associated with, for example, a mining company, a property owner, a contractor, an equipment rental business, and/or another worksite entity. Worksite computing system 44 may include, for example, a server computer, a desktop computer, a laptop computer, a personal digital assistant (PDA), a hand-held device (e.g., a Pocket PC or a Blackberry®), or another suitable computing device known in the art. Worksite computing system 44 may be situated on or near worksite 10, such as in a worksite headquarters (e.g., an onsite trailer), or at remote location, such as at a corporate headquarters.

Sensors 42 may be positioned on and/or mounted to worksite infrastructure (see FIG. 1), such as, for example, conveyor 14, and configured to scan workpile surface 30. Sensors 42 may alternatively or additionally include stand-alone units positioned on workpile surface 30. Sensors 42 may embody LIDAR (light detection and ranging) devices (e.g., a laser scanner), RADAR, (radio detection and ranging) devices, SONAR (sound navigation and ranging) devices, camera devices, and/or another devices that may sense points on workpile surface 30 and determine the distance and direction to the sensed points. Sensors 42 may scan workpile surface 30 to sense the points individually and/or as point clusters (i.e., a "point cloud").

Sensors 42 may be equipped and/or associated with a timing device (not shown) and configured to determine times at which the points are scanned. Additionally, sensors 42 may be equipped with GPS and/or other position- and orientation-determining devices to determine a location of sensors 42 on worksite 10, as well as a pitch, roll, and/or yaw of sensors with respect to worksite 10; that is, to determine the location and orientation of sensors 42 on worksite 10.

Figure 4:
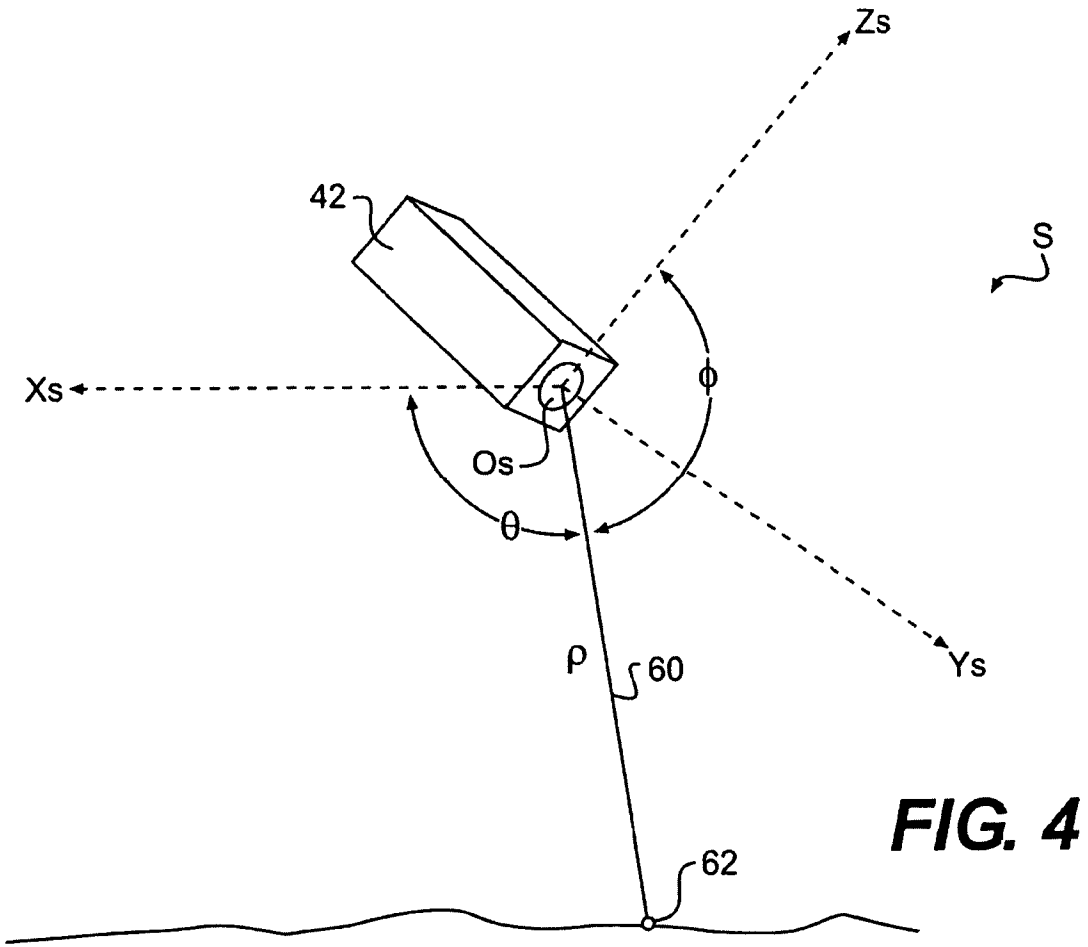
FIG. 4 shows an exemplary coordinate system of a sensor of the worksite avoidance system of FIG. 3.

FIG. 4 shows a coordinate system S that may be used by sensors 42 to describe the location of scanned points on workpile surface 30 with respect to the sensors' positions and orientations on worksite 10. That is, coordinate system S may define the location of scanned points on workpile surface 30 with respect to the frames of reference of sensors 42 (i.e., distances and directions from sensors 42 to scanned points on workpile surface 30). Coordinate system S may be a right-handed 3-D Cartesian coordinate system having axis vectors $X_S$, $Y_S$, and $Z_S$. A point in coordinate system S may be referenced by coordinates in the Cartesian form $X_S=[s_1\ s_2\ s_3]$ where, from origin point $O_S$ (the location of a respective sensor 42 on worksite 10), $s_1$ is the distance along axis vector $X_S$, $s_2$ is the distance along axis vector $Y_S$, and $s_3$ is the distance along axis vector $Z_S$. A point in coordinate system S may alternatively or additionally be referenced by polar coordinates in the form $X_{SP}=[\rho\ \theta\ \phi]$, where $\rho$ is the distance from point $O_S$, $\theta$ is the polar angle from axis vector $X_S$, and $\phi$ is the polar angle from the axis vector $Z_S$.

Sensors 42 may emit a beam pulse 60 to measure the distance between sensors 42 and a point 62 on workpile surface 30. Beam pulse 60 may be reflected off of point 62 and received by sensors 42. Sensors 42 may compute the distance $\rho$ between sensors 42 and point 62 based on a measured time required by beam pulse 60 to travel to, reflect off, and return from point 62. Beam pulse 60 may be emitted at an angle $\theta$ from the Xs axis vector along the $X_S$-$Y_S$ plane, varied between 0 degrees and 180 degrees; and at an angle $\phi$ from the Zs axis vector along the $X_S$-$Y_S$ plane, varied between 0 degrees and 180 degrees. Sensors 42 may communicate to worksite computing system 44 signals containing information about the locations of point 62. For example, these signals may include the locations of points 62 in coordinate system S in the form:

$$X_{SP} = \begin{bmatrix} \rho_1 & \theta_1 & \theta_1 \\ \rho_2 & \theta_2 & \phi_2 \\ \vdots & \vdots & \vdots \\ \rho_n & \theta_n & \phi_n \end{bmatrix}, \tag{3}$$

where each row represents a point 62 on workpile surface 30 in polar coordinates with respect to sensor coordinate system S.

The signals may be communicated to worksite computing system 44 periodically, such as in real-time, in near real-time, and/or at any other desired interval. It is to be appreciated, however, that an accurate, real-time representation of workpile surface 30 may be maintained by worksite computing system 44 if signals indicating the location of points 62 are frequently communicated by sensors 42. The locations of scanned points 62 may be used by worksite computing system 44 in subsequent determinations discussed below. Sensors 42 may also communicate signals containing additional information, such as, for example, times at which the points were scanned; a pitch, roll, and/or yaw of sensors 42; a position of sensors 42 (e.g., a GPS location); and/or other information.

As shown by FIG. 3, worksite computing system 44 may include a terrain map database 46 and a worksite layout database 48 in communication with a worksite avoidance system controller 50. Sensors 42 and vehicles 38 may communicate with controller 50 via a communication link 52 (e.g., a wireless radio network, a satellite network, a wired network, a fiber optic network, a cellular network, an Ethernet, the Internet, and/or any combination thereof).

Figure 5:
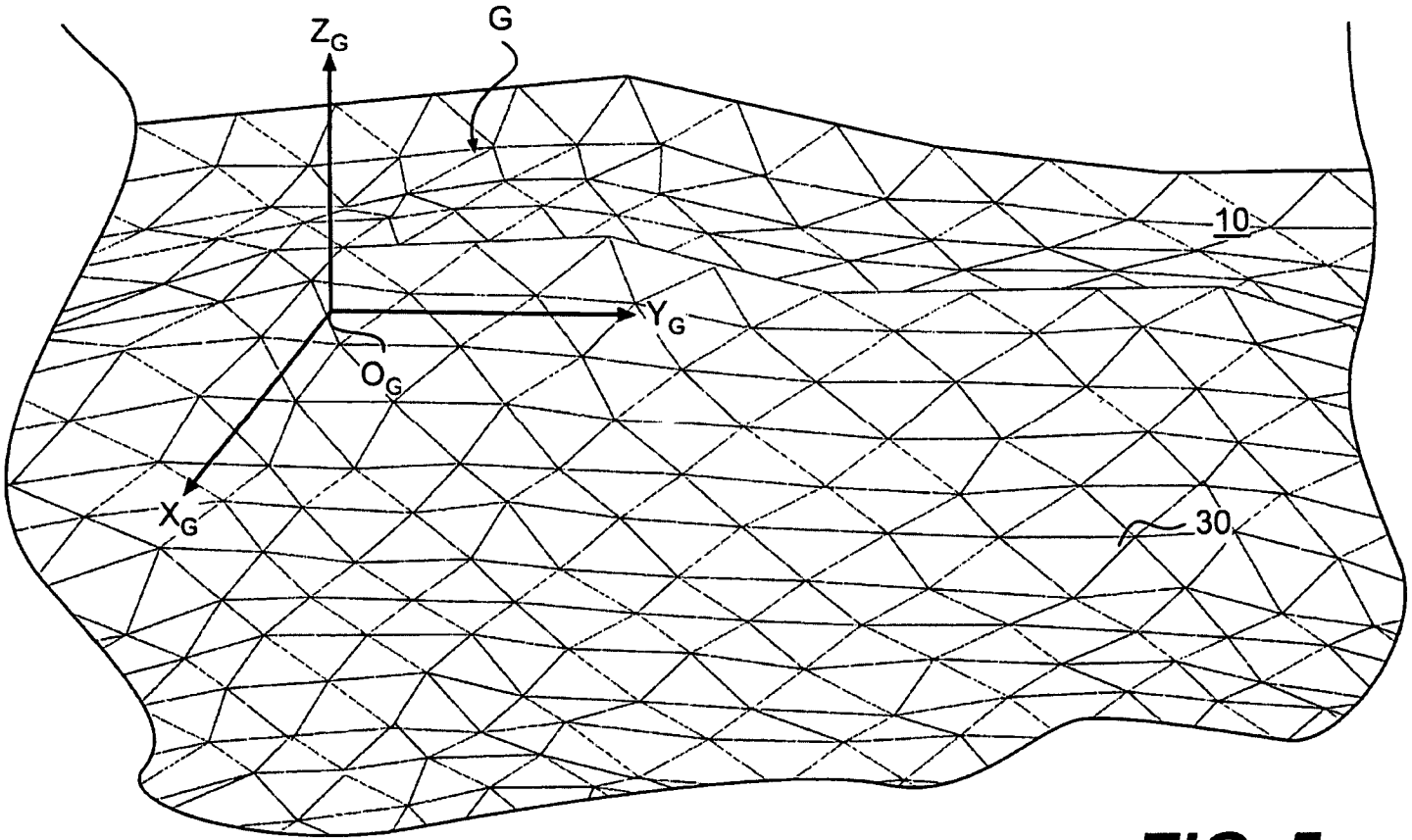
FIG. 5 shows an exemplary coordinate system of the worksite of FIG. 1.

Terrain map database 46 may contain points defining workpile surface 30 (e.g., from a scan by sensors 42 of workpile surface 30). Referring to FIG. 5, the points may be stored in terrain map database 46 with respect to a coordinate system G associated with worksite 10, for example. Coordinate system G may be a right-handed 3-D Cartesian coordinate system having its origin at a point $O_G$, and having axis vectors $X_G$, $Y_G$, and $Z_G$. Axis vectors $X_G$, $Y_G$ and $Z_G$ may point to magnetic East, magnetic North, and gravitationally upward on worksite 10, respectively. A point in coordinate system G may be referenced by coordinates in the form $X_G=[g_1\ g_2\ g_3]$, where, from origin point $O_G$, $g_1$ is the distance along axis vector $X_G$, $g_2$ is the distance along axis vector $Y_G$, and $g_3$ is the distance along axis vector $Z_G$. Terrain map database 46 may be periodically updated by controller 50 with information received from sensors 42 to dynamically reflect workpile surface 30 as it changes. For example, terrain map database 46 may store a matrix of points defining workpile surface 30, which may be periodically updated by controller 50.

Worksite layout database 48 may store information about the layout of worksite 10. For example, worksite layout database 48 may include a map of points defining the geographical layout of worksite 10 without (i.e., excluding) material 16, workpile 18, vehicles 38, workers, and/or other transient objects on worksite 10. That is, worksite layout database 48 may define the geographical layout of permanent features of worksite 10. Such permanent features may include worksite infrastructure, such as conveyor 14, opening 20, buildings, structural supports; bottom 35 of worksite 10 (i.e., the surface upon which workpile 18 sits); and/or any other permanent structural aspects of worksite 10.

Worksite layout database 48 may be created based on a scan of worksite 10 when "empty"; that is, when material 16, vehicles 38, workers, and/or other objects are absent from worksite 10. Alternatively or additionally, worksite layout database 48 may be created based on a survey of worksite 10, satellite or aerial imagery of worksite 10, schematics, and/or other sources. Like terrain map database 46, points stored in worksite layout database 48 may be associated with worksite coordinate system G, discussed above. In addition, these points may be tagged to indicate the object with which they are associated (e.g., conveyor 14, opening 20, etc.). Controller 50 may access, compare, or otherwise leverage terrain map database 46 and worksite layout database 48 in connection with determinations discussed below.

Controller 50 may include any means for receiving information, for monitoring, recording, storing, indexing, processing, and/or communicating information relating to the operation of worksite avoidance system 40. These means may include components such as, for example, a central processing unit (CPU), a memory, one or more data storage devices, and/or or any other computing components used to run an application. Commercially available microprocessors (e.g., an application-specific integrated circuit (ASIC), a field-programmable gate array (FPGA), and/or another integrated circuit device) may be configured to perform the functions of controller 50

Furthermore, although aspects of the present disclosure may be described generally as being stored in memory, one skilled in the art will appreciate that these aspects can be stored on or read from different types of computer-readable storage media associated with controller 50. The computer-readable storage media may include, for example, optical storage, magnetic storage (e.g., a hard disk), solid state storage, a CD-ROM, a DVD-ROM, RAM, ROM, a flash drive, and/or any other suitable computer-readable storage media.

Controller 50 may relate scanned points 62 (FIG. 4) in sensor coordinate system S to their corresponding locations in worksite coordinate system G to allow processes discussed below to be performed. In particular, controller 50 may relate scanned points 62 in sensor coordinate system S in polar form to their corresponding Cartesian coordinates in sensor coordinate system S. The relationship between polar coordinates (i.e., $X_{SP}$) and Cartesian coordinates in coordinate system S in Cartesian form (i.e., $X_S$) may be as follows:

$$X_S = \begin{bmatrix} \rho_1\cos\theta_1 & \rho_1\sin\theta_1 & \rho_1\cos\phi_1 \\ \rho_2\cos\theta_2 & \rho_2\sin\theta_2 & \rho_2\cos\phi_2 \\ \vdots & \vdots & \vdots \\ \rho_n\cos\theta_n & \rho_n\sin\theta_n & \rho_n\cos\phi_n \end{bmatrix}, \quad (4)$$

where each row represents one point 62 on workpile surface 30 with respect to sensor coordinate system S in Cartesian coordinates.

Additionally, controller 50 may account for translational and rotational offsets between sensor coordinate system S and worksite coordinate system G. It is to be appreciated that sensors 42 may be positioned at any desired locations and/or orientations on worksite 10. Additionally, sensors 42 may be positioned on vehicles 38 and/or other mobile objects. Further, stand-alone sensors 42 may be moved about worksite 10 from time to time in order to improve scanning performance. Thus, sensor coordinate system S may have an arbitrary location and/or orientation with respect to worksite coordinate system G. Controller 50 may therefore require the relationship between coordinate systems S and G to relate points Xs in sensor coordinate system S to corresponding points $X_G$ in worksite coordinate system G. In this manner, scanned points 62 may be rendered meaningful and utilized by controller 50 in connection with determinations disclosed herein.

The location of origin point $O_S$ and the orientation of sensor coordinate system S relative to worksite coordinate system G may be fixed, known, and/or determined, depending on the configuration of sensors 42. The corresponding location of origin point $O_S$ in worksite coordinate system G, $X_G(O_S)$, may be defined as $[-b_{S1}\ -b_{S2}\ -b_{S3}]$, where $b_{S1}$, $b_{S2}$, and $b_{S3}$ are translational offsets of sensors 42 in worksite coordinate system G along the axis vectors $X_G$, $Y_G$ and $Z_G$, respectively. That is, $b_{S1}$, $b_{S2}$, and $b_{S3}$ may be Cartesian coordinates defining the location of sensors 42 in coordinate system G. Further, the rotational offset of sensor coordinate system S with respect to worksite coordinate system G, $A_G(R_S)$, may be defined as [ps ys rs], where ps, ys, and rs are the pitch, yaw, and roll, respectively, of sensor coordinate system S with respect to worksite coordinate system G. In other words, ps, ys, and rs may define the pitch, yaw, and roll, respectively, of sensors 42 with respect to worksite 10, or the direction that sensors 42 are "pointing" with respect to the worksite 10.

In one embodiment, the values for $b_{S1}$, $b_{S2}$, and $b_{S3}$ and ps, ys, and rs may be predetermined and fixed. For example, a technician may mount or otherwise position sensors 42 in desired locations on worksite 10 in a "permanent" fashion (e.g., mounted on conveyor 14). The technician may then measure the translational offsets $b_{S1}$, $b_{S2}$, and $b_{S3}$ as well as the rotational offsets ps, ys, and rs. These measured offsets may then be provided to worksite avoidance system 40 for subsequent determinations (e.g., entered a graphical user interface application or the like).

In another embodiment, the values for $b_{S1}$, $b_{S2}$, and $b_{S3}$ and ps, ys, and rs may vary periodically. For example, sensors 42 may be mounted on vehicles 38 and/or on a tripod periodically moved about worksite 10. In such a case, sensors 42 may be equipped with positioning and/or orientation devices, such as a global positioning systems (GPS), Inertial Reference Units (IRU), and odometric or dead-reckoning devices, laser level sensors, tilt sensors, inclinometers, gyrocompasses, radio direction finders, and/or other suitable devices for determining position and orientation known in the art. Sensors 42 may communicate to controller 50 signals indicative of the determined positions and/or orientations; that is, signals including values for $b_{S1}$, $b_{S2}$, and $b_{S3}$ and ps, ys, and rs.

Using these translational and rotational offset values, controller 50 may further relate points 62 in sensor coordinate system S in Cartesian form to their corresponding locations in worksite coordinate system G in Cartesian form:

$$X_G = \begin{bmatrix} [A_S X_{S1}^G + B_S]^G \\ [A_S X_{S2}^G + B_S]^G \\ \vdots \\ [A_S X_{Sn}^G + B_S]^G \end{bmatrix}, \quad (5)$$

where $X_{S1}$ is the first row of $X_S$, $X_{S2}$ is the second row of $X_S$, and $X_{Sn}$ is the nth row of $X_S$; $A_S = A_{ys} A_{ps} A_{rs}$, and represents the rotational transform from sensor coordinate system S in Cartesian form to worksite coordinate system G; and $$A_{ys} = \begin{bmatrix} \cos ys & -\sin ys & 0 \\ \sin ys & \cos ys & 0 \\ 0 & 0 & 1 \end{bmatrix}, \quad (6)$$

$$A_{ps} = \begin{bmatrix} \cos ps & 0 & -\sin ps \\ 0 & 1 & 0 \\ \sin ps & 0 & \cos ps \end{bmatrix}, \quad (7)$$

$$A_{rs} = \begin{bmatrix} 1 & 0 & 0 \\ 0 & \cos rs & -\sin rs \\ 0 & \sin rs & \cos rs \end{bmatrix}, \quad (8)$$

and $$B_S = \begin{bmatrix} b_{S1} \\ b_{S2} \\ b_{S3} \end{bmatrix}, \quad (9)$$

and represents the translational transform from sensor coordinate system S in Cartesian form to worksite coordinate system G. In addition, controller 50 may perform filtering to remove extraneous points not associated with workpile surface 30, according to methods known in the art.

Figure 6:
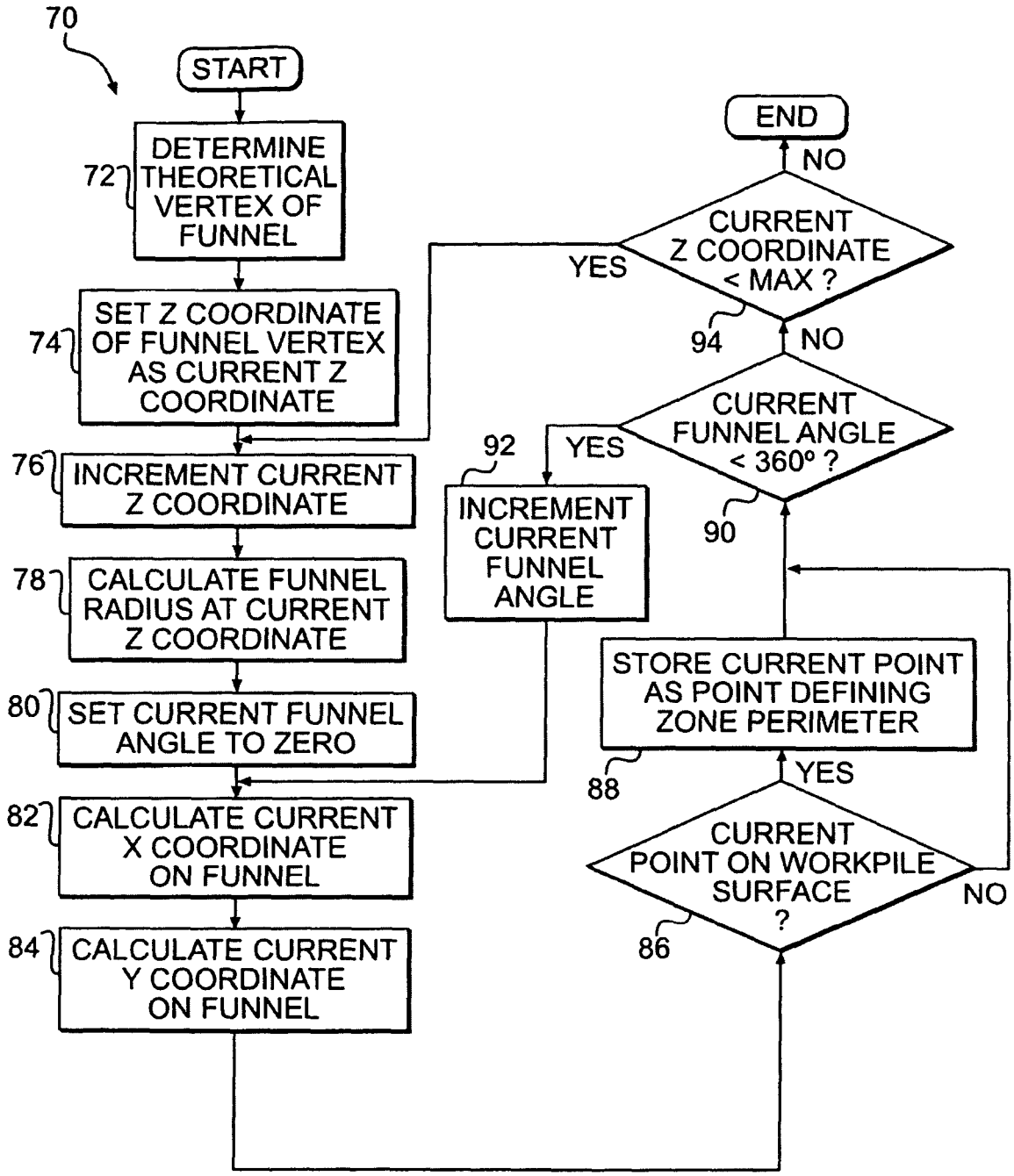
FIG. 6 shows a flowchart illustrating an exemplary disclosed process for identifying a disturbance zone on the surface of the workpile in FIG. 1.

Controller 50 may identify points on workpile surface 30 falling on zone perimeter 36. In other words, controller 50 may determine where funnel 28 "intersects" workpile surface 30. FIG. 6 shows an exemplary disclosed process 70 of determining points on workpile surface 30 that define zone perimeter 36 that may be implemented by controller 50 (and thereby identify disturbance zone 32).

Initially, controller 50 may determine the theoretical vertex ($X_{f0}$, $Y_{f0}$, $Z_{f0}$) of funnel 28 in worksite coordinate system G (step 72). For example, controller 50 may retrieve the vertex point from worksite layout database 48 or calculate the vertext point based on the known location of opening 20 and angle of repose $\theta_R$ of material 16. The vertex of funnel 28 may represent the point at which funnel 28 would have a radius of zero (i.e., the bottom point funnel 28).

Controller 50 may then set $Z_{fo}$ (i.e., the z coordinate of funnel vertex ($X_{f0}$, $Y_{f0}$, $Z_{f0}$)) to a current z coordinate of funnel 28 (step 74) as follows:

$$Z_{fi} = Z_{fo}, \quad (10)$$

where $Z_{fi}$ is the current z coordinate of funnel 28.

Next, controller 50 may increase $Z_{fi}$ by a predetermined increment (step 76). That is, controller 50 may increment vertically (i.e., upward) toward workpile surface 30 from the funnel vertex ($X_{f0}$, $Y_{f0}$, $Z_{f0}$) as follows:

$$Z_{fi} = Z_{fi} + \Delta Z, \quad (11)$$

where $\Delta Z$ is a predetermined vertical increment (e.g., 0.25 meters). Increment $\Delta Z$ may be selected or determined based on a desired resolution with which points on funnel 28 and, thus, an accuracy with which points defining zone perimeter 36, may be calculated.

Controller 50 may then calculate a radius of funnel 28 at $Z_{fi}$ (step 78). That is, controller 50 may calculate the radius of funnel 28 at a height h corresponding to $Z_{fi}$. The radius may be calculated as follows:

$$R_i = Z_{fi} \sin(90 - \theta_R), \quad (12)$$

where $Z_{fi}$ is the current z coordinate of funnel 28, and $\theta_R$ is the angle of repose of material 16.

Figure 7:
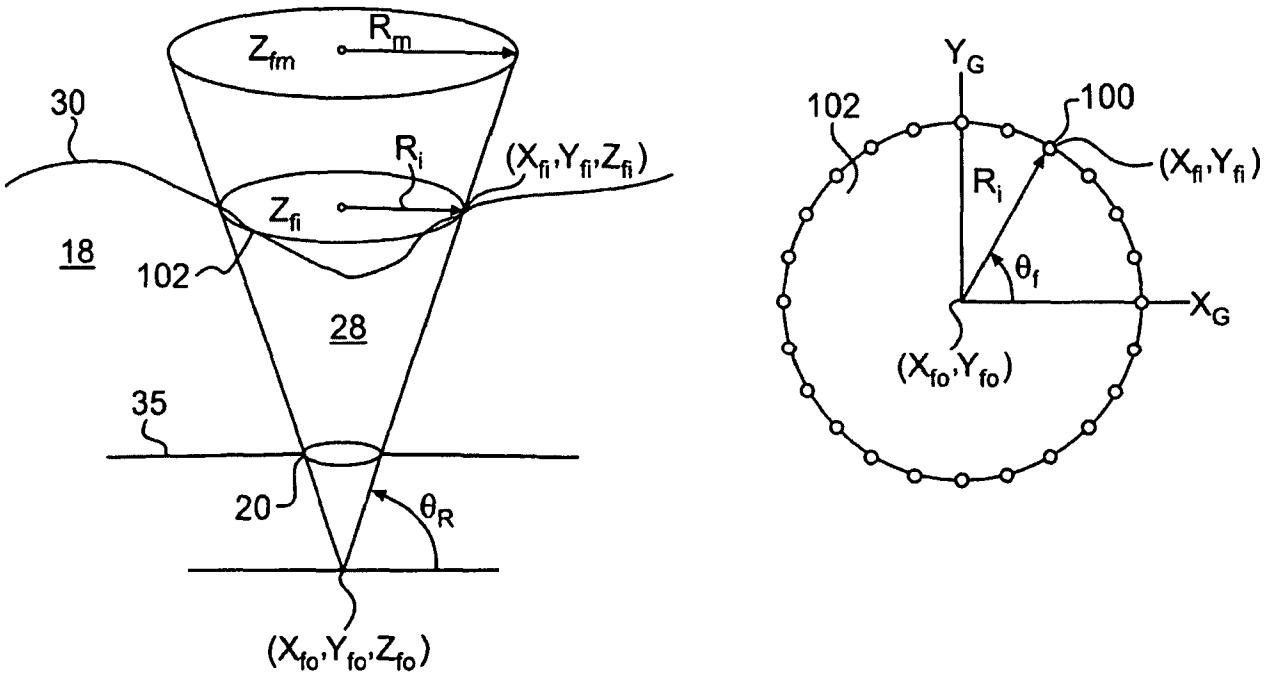
FIG. 7 is an illustration for explaining the process of FIG. 6.

Controller 50 may then set a current funnel angle $\theta_f$ to zero (step 80), and may calculate a corresponding x coordinate on funnel 28 for the current z coordinate $Z_{fi}$ on funnel 28 and the current funnel angle $\theta_f$ (step 82) as follows:

$$X_{fi} = X_{f0} + R_i \cos \theta_f, \quad (13)$$

where $X_{f0}$ is the x coordinate of the funnel vertex ($X_{f0}$, $Y_{f0}$, $Z_{f0}$), $R_i$ is the radius of funnel 28 at $Z_{fi}$, and $\theta_f$ is the current funnel angle. Referring to FIG. 7, it is to be appreciated that current funnel angle $\theta_f$ may correspond to a radial position 100 on a horizontal cross-sectional "slice" 102 (FIG. 7) of funnel 28 at the current z coordinate $Z_{fi}$.

Similarly, controller 50 may calculate a corresponding y coordinate on funnel 28 for the current z coordinate $Z_{fi}$ and the current funnel angle $\theta_f$ (step 84) as follows:

$$Y_{fi} = Y_{f0} + R_i \sin \theta_f, \quad (14)$$

where $Y_{f0}$ is they coordinate of the funnel vertex ($X_{f0}$, $Y_{f0}$, $Z_{f0}$), $R_i$ is the radius of funnel 28 at $Z_{fi}$, and $\theta_f$ is the current funnel angle.

Controller 50 may then determine whether the current point ($X_{fi}$, $Y_{fi}$, $Z_{fi}$) on funnel 28 is located on workpile surface 30 (step 86). It is to be appreciated that a current point ($X_{fi}$, $Y_{fi}$, $Z_{fi}$) on funnel 28 that is also on workpile surface 30 may be a point defining zone perimeter 36. Controller 50 may determine whether current point ($X_{fi}$, $Y_{fi}$, $Z_{fi}$) on funnel 28 is on workpile surface 30 by determining whether:

$$(X_{fi}, Y_{fi}, Z_{fi}) = (X_{Gi}, Y_{Gi}, Z_{Gi}), \quad (15)$$

where ($X_{Gi}$, $Y_{Gi}$, $Z_{Gi}$) is any one of points $X_G$ defining workpile surface 30. Controller 50 may determine that ($X_{fi}$, $Y_{fi}$, $Z_{fi}$)=($X_{Gi}$, $Y_{Gi}$, $Z_{Gi}$) when, for example, the values of the corresponding coordinates are within a certain tolerance (e.g., +/−0.5 meters), and/or a distance between ($X_{fi}$, $Y_{fi}$, $Z_{fi}$) and ($X_{Gi}$, $Y_{Gi}$, $Z_{Gi}$) is within a certain tolerance. In other words, in step 86, controller 50 may determine whether current point ($X_{fi}$, $Y_{fi}$, $Z_{fi}$) on funnel 28 is contained in the matrix of points $X_G$ defining workpile surface 30.

If controller 50 determines in step 86 that the current point ($X_{fi}$, $Y_{fi}$, $Z_{fi}$) on funnel 28 is on workpile surface 30, controller 50 may store in memory the current point ($X_{fi}$, $Y_{fi}$, $Z_{fi}$) as a point defining zone perimeter 36 (step 88):

$$X_{zp} = \begin{bmatrix} x_{ZP1} & y_{ZP1} & z_{ZP1} \\ x_{ZP2} & y_{ZP2} & z_{ZP2} \\ \vdots & \vdots & \vdots \\ x_{ZPn} & y_{ZPn} & z_{ZPn} \end{bmatrix}, \quad (16)$$

where each row represents a current point ($X_{fi}$, $Y_{fi}$, $Z_{fi}$) on funnel 28 determined in step 86 to be on workpile surface 30 (i.e., on zone perimeter 36), with respect to worksite coordinate system G.

If controller 50 determines in step 86 that the current point the current point ($X_{fi}$, $Y_{fi}$, $Z_{fi}$) on funnel 28 is not on workpile surface 30 (i.e., not on zone perimeter 36) or, after completion of step 88, controller 50 may determine whether the current funnel angle $\theta_f$ is less than 360 degrees (step 90). In other words, controller 50 may determine in step 90 whether x and y coordinates have been calculated and compared to the points $X_G$ defining workpile surface 30, for each radial position 100 on cross-sectional "slice" 102 (FIG. 7) of funnel 28 for the current z coordinate $Z_{fi}$.

If controller 50 determines in step 90 that the current funnel angle $\theta_f$ is less than 360 degrees, controller 50 may increase the current funnel angle $\theta_f$ by a predetermined increment (step 92) according to:

$$\theta_f=\theta_f+\Delta\theta_f, \tag{17}$$

where, $\Delta\theta_f$ is a predetermined increment (e.g., 1 degree). Increment $\Delta\theta_f$ may be selected or determined based on a desired resolution with which points on worksite surface 30 defining zone perimeter 36 may be may be calculated. It is to be appreciated that increment $\Delta\theta_f$ may define an angular offset between radial positions 100 on cross-sectional slice 102. After completion of step 92, controller 50 may return to step 82.

It is to be appreciated that steps 82-92 may be described as taking a horizontal cross-sectional slice 102 (FIG. 7) of funnel 28, and comparing points defining a perimeter of cross-sectional slice 102 to points $X_G$ defining workpile surface 30. Any points defining cross-sectional slice 102 that are substantially equal to any of points $X_G$ defining workpile surface 30 may define zone perimeter 36.

If controller 50 determines in step 90 that the current funnel angle $\theta_f$ is not less than 360 degrees, controller 50 may determine whether the current z coordinate $Z_{fi}$ on funnel 28 is less than a predetermined maximum $Z_{fm}$ (corresponding to a maximum funnel radius $R_m$) (step 94). If so, controller 50 may return to step 76. That is, controller 50 may take another horizontal cross-sectional slice 102 of funnel 28 corresponding to a greater workpile height h, and repeat steps 78-94. Otherwise, controller 50 may end process 70.

Controller 50 may receive, via communication link 52, real-time updates of positions and/or orientations of vehicles 38 on workpile surface 30. For example, controller 50 may receive position and/or heading information (i.e., pitch, yaw, and/or roll) from vehicles 38. Controller 50 may convert the positions of vehicles 38 into corresponding coordinates in worksite coordinate system G. The coordinates of vehicles 38 may be stored in memory in matrix form:

$$X_V = \begin{bmatrix} x_{V1} & y_{V1} & z_{V1} \\ x_{V2} & y_{V2} & z_{V2} \\ \vdots & \vdots & \vdots \\ x_{Vn} & y_{Vn} & z_{Vn} \end{bmatrix}, \tag{18}$$

where each row represents a point defining the real-time position of a vehicle 38 on workpile surface 30 with respect to worksite coordinate system G.

It is to be appreciated that controller 50 repeat process 70 to update points $X_{zp}$ periodically, in real-time, and/or in near real-time, in order to maintain an accurate definition of zone perimeter 36 (i.e., as additional data is provided to controller 50 by sensors 42).

Controller 50 may periodically or continuously calculate distances between vehicles 38 and zone perimeter 36. Specifically, controller 50 may perform a distance calculation between points $X_{zp}$ defining zone perimeter 36 and points $X_v$ defining the real-time position of vehicles 38 on workpile surface 30 according to:

$$dn = \sqrt{((x_{Vn} - x_{ZPn})\text{^}2 + (y_{Vn} - y_{ZPn})\text{^}2 + (z_{Vn} - z_{ZPn})\text{^}2)} \tag{19}$$

where $d_n$ is the distance between vehicle 38 and a point defining zone perimeter 36.

If controller 50 determines that the calculated distance $d_n$ is less than a threshold (e.g., 5 feet), controller 50 may transmit an alert signal to vehicles 38; that is, when a vehicle travels too close to, or into, zone 32. Controller 50 may establish one or more buffer areas (not shown) surrounding zone 32, and similarly transmit an alert signal to vehicle 38 that travel too close to or into the buffer areas. In such a case, it is contemplated that a severity of the alert signal may be based upon the proximity of vehicles to zone 32.

In addition, controller 50 may transmit signals containing points $X_G$ defining workpile surface 30 and points $X_{zp}$ defining zone perimeter 36 to vehicles 38 so that vehicles 38 may display workpile 18 and/or zone 32 to vehicle operators. In this manner, vehicle operators may manually take precautions to avoid zone 32 while operating vehicles 38 on workpile 18. Likewise, autonomous (i.e., unmanned) vehicles 38 may avoid zone 32.

Figure 8:
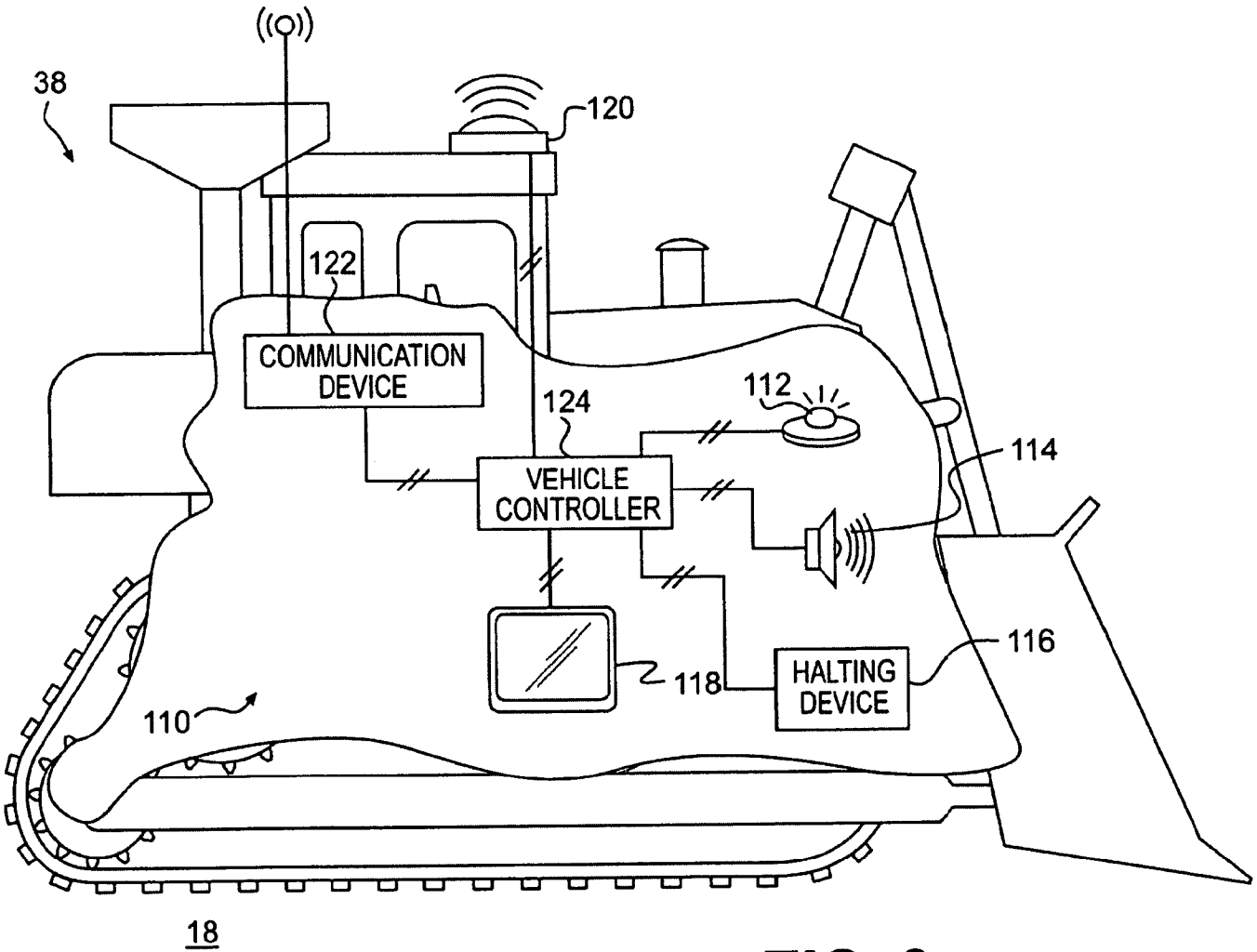
FIG. 8 shows an exemplary vehicle that may operate on the worksite of FIG. 1.

FIG. 8 shows an exemplary vehicle 38 that may operate on workpile 18. Vehicle 38 may be controlled by an onboard operator, remotely controlled by an off-site operator, and/or autonomously controlled. In the case of autonomous control, for example, vehicle 38 may be programmed to repeatedly move material 16 from one or more locations on workpile 18, along a prescribed path, into zone 32.

Vehicle 38 may include an onboard system 110 for controlling various operations of vehicle 38. Onboard system 110 may include a visual alert device 112, an audible alert device 114, a vehicle halting device 116, an operator display device 118, a positioning device 120, and a communication device 122 in communication with a vehicle controller 124. In an embodiment utilizing an autonomous vehicle 38, however, visual alert device 112, audible alert device 114, operator display device 118, and/or other devices may be omitted.

Visual alert device 112 may include a lamp, an LED, or another device configured to illuminate in response to a signal from vehicle controller 124. Audible alert device 114 may include a speaker or another audio transducer configured to generate an audible signal in response to a signal provided by vehicle controller 124.

Vehicle halting device 116 may include vehicle brakes, switches, valves, motors, and/or other means (not shown) configured to halt operation of vehicle 38 (e.g., bring to a stop, slow down, power down, etc.) in response to a signal from vehicle controller 124.

Operator display device 118 may include a CRT device, a LCD device, a plasma device, a projection display device (e.g., a HUD), and/or any other display device known in the art. Operator display device 118 may display images in response to signals provided by vehicle controller 124.

Positioning device 120 may include a global positioning system (GPS), an Inertial Reference Unit (IRU), an odometric or dead-reckoning device, a laser level sensor, a tilt sensor, an inclinometer, a gyrocompass, a radio direction finders, a speed sensor, an accelerometer, and/or other devices configured to provide signals indicative of the position, pitch, roll, tilt, speed, acceleration, and/or other information relating to the movement of vehicle 38 to vehicle controller 124.

Communication device 122 may include any device configured to facilitate communications between vehicle 38 and worksite computing system 44. For example, communication device 122 may include an antenna, a transmitter, a receiver, and/or any other devices that enable vehicle to wirelessly exchange information with worksite computing system 44 via communication link 52.

Vehicle controller 124 may include any means for receiving information and/or for monitoring, recording, storing, indexing, processing, and/or communicating information relating to the operation of vehicle 38. These means may include components such as, for example, a central processing unit (CPU), a memory, one or more data storage devices, and/or or any other computing components used to run an application. Commercially available microprocessors (e.g., an application-specific integrated circuit (ASIC), a field-programmable gate array (FPGA), and/or another integrated circuit device) may be configured to perform the functions of vehicle controller 124. Various other known circuits may be associated with vehicle controller 124, such as power supply circuitry, signal-conditioning circuitry, solenoid driver circuitry, communication circuitry, and other appropriate circuitry.

Vehicle controller 124 may periodically receive from worksite computing system 44 (e.g., in real-time, near real-time, and/or at any other desired interval), via communication link 52 points $X_G$ defining workpile surface 30 and points $X_{zp}$ defining zone perimeter 36. Vehicle controller 124 may further receive alert signals transmitted by worksite computing system 44. Vehicle controller 124 may communicate to worksite computing system 44 position, pitch, roll, tilt, speed, acceleration, and/or other information relating to the movement of vehicle 38 received from positioning device 120.

Figure 9:
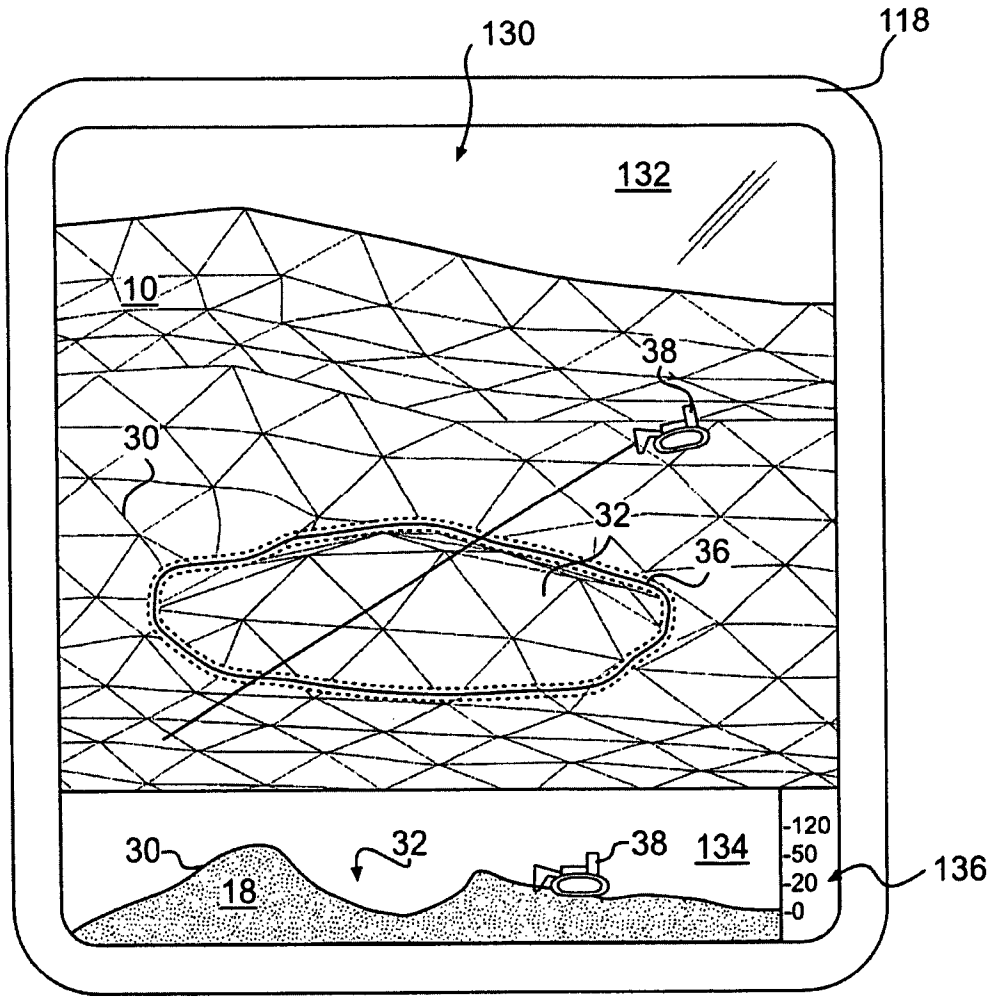
FIG. 9 shows a representation of an exemplary display provided on a display device associated with the vehicle of FIG. 8.

FIG. 9 shows an exemplary display 130 of worksite 10 that may be provided on operator display device 118 by vehicle controller 124. Vehicle controller 124 may render display 130 using points $X_G$ defining workpile surface 30; points $X_{zp}$ defining zone perimeter 36; vehicle positioning data from positioning device 120; and/or other information. Display 130 may include an overhead view 132 of worksite 10, showing workpile surface 30, zone 32, zone perimeter 36, and/or the relative location of vehicle 38 on workpile surface 30 with respect to zone 32. Display 130 may further include a side view 134 of worksite 10. Side view 134 may show a vertical cross section of workpile 18, and the relative location of vehicle 38 on workpile surface 30 with respect to zone 32. Side view 134 may also include a legend 136 indicating the elevation of workpile 18 above bottom surface 35 of worksite 10.

Display 130 may be periodically or continuously updated as the position and/or orientation of vehicle 38 changes and/or as new points $X_G$ defining workpile surface 30 and points $X_{zp}$ defining zone perimeter 36 are received. As shown in FIG. 9, zone 32 and/or zone perimeter 36 may be visually distinguished on operator display device 118, such as by coloring, shading, flashing, etc. Further, buffer areas (not shown) established around zone 32 may also be shown on operator display device 118. Thus, the vehicle operator may be made aware of the presence, location, size, and/or shape of zone 32, as well as the vehicle's location on worksite 10 with respect to zone 32.

Vehicle controller 124 may also perform one or more actions in response to receiving an alert signal from worksite avoidance system controller 50 (i.e., when vehicle 38 travels within a certain distance of, or into, zone perimeter 36). For example, vehicle controller 124 may send a signal to cause visual alert device 112 to illuminate, flash, etc., and thereby alert the vehicle operator that vehicle 38 has traveled too close to, or into, zone 32.

Vehicle controller 124 may alternatively or additionally send a signal to cause vehicle halting device 116 to halt operation of vehicle 38. For example, vehicle halting device 116 may power down vehicle 38, apply the vehicle's brakes, disengage the vehicle's transmission, reduce engine speed, and/or otherwise prevent vehicle 38 from entering or traveling further into zone 32. It is contemplated that a vehicle operator may be able to override the halting of vehicle 38, if desired.

Vehicle controller 124 may alternatively or additionally send a signal to cause audible alert device 114 to audibly alert the vehicle operator that vehicle 38 has traveled too close to, or into, zone 32. For example, audible alert device 114 may produce a disagreeable noise (e.g., a siren), or announce a message (e.g., "This vehicle has entered a restricted area on the worksite. Please exit immediately.").

In another example, vehicle controller 124 may cause a similar message to be displayed on operator display device 118. This message may be augmented by, for example, the flashing of zone 32 and/or zone perimeter 36 on image 90 shown on operator display device 118 and/or another graphical alert provided on operator display device 118.

In a case where vehicle 38 is autonomous or unmanned and controlled to complete a programmed task, vehicle controller 124 may control operations of vehicle 38 such that zone 32 is avoided. For example, vehicle controller 124 may control vehicle 38 such that at least a minimum distance is maintained between the vehicle's position and points $X_{zp}$ defining zone perimeter 36.

INDUSTRIAL APPLICABILITY

The disclosed terrain mapping and avoidance system may be applicable to any situation where vehicles or other objects are operated on a material workpile sitting on a worksite. The disclosed system may be particularly useful where material in the workpile is released through an opening at the worksite (e.g., for collection), causing a dynamic disturbance zone to form on the surface of the workpile.

Figure 10:
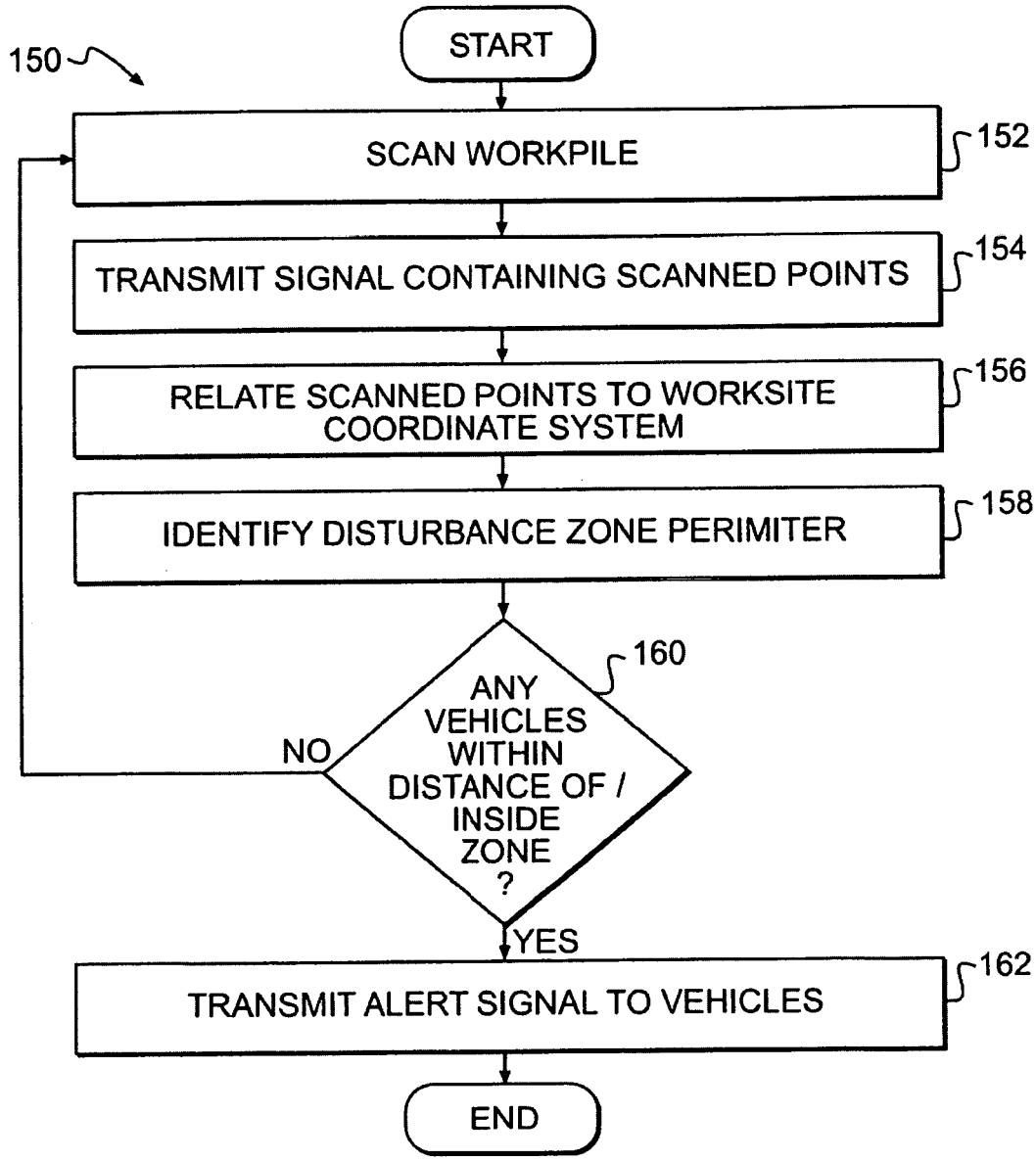
FIG. 10 shows a flowchart illustrating exemplary operation of the worksite avoidance system of FIG. 1.

Operation of worksite avoidance system 40 will now be explained with reference to the flowchart 150 shown in FIG. 10. While vehicles 38 are operating on workpile 18, sensors 42 may scan workpile surface 30 (step 152). Specifically, sensors 42 may emit beam pulses 60 and compute the location $X_{SP}$ of points 62 on workpile surface 30 with respect to sensor coordinate system S, as discussed above. Sensors 42 may then transmit signals containing points $X_{SP}$, via communication link 52, to controller 50 (step 154).

Controller 50 may relate points $X_{SP}$ transmitted by sensors 42 to their corresponding coordinates $X_G$ in worksite coordinate system G, as discussed above (step 156). These points $X_G$ may be stored in matrix form in memory.

Controller 50 may then identify points $X_{zp}$ on workpile surface 30 falling on zone perimeter 36, as discussed in detail above with respect to FIG. 6 (step 158).

Controller 50 may then determine whether any vehicles 38 are within a certain distance of (or inside) zone 32, as discussed above (step 160). If vehicles 38 are found to be within the certain distance of (or inside) zone 32, controller 50 may transmit an alert signal to those vehicles (step 162). If no vehicles 38 are found to be too close to (or inside) zone 32, controller 50 may return to step 152.

In response to receiving an alert signal, vehicle controller 124 may perform one or more of the actions discussed above.

For example, vehicle controller 124 may provide a visual and/or audible alert to the vehicle operator by way of visual alert device 112 and/or audible alert device 114, respectively; and/or halt operation of vehicle 38 by way of vehicle halting device 116.

In addition, during any of steps 152-162 discussed above, controller 50 may continuously or periodically transmit to vehicles 38 signals containing points $X_{zp}$ defining zone perimeter 36 and points $X_G$ defining workpile surface 30. Thus, vehicle controller 124 may provide the vehicle operator with display 130 worksite 10, described above. Further, in an autonomous vehicle 38, vehicle controller 124 may control the travel of vehicle 38 on worksite 10 such that zone 32 is avoided.

The disclosed terrain mapping and avoidance system may help vehicles operating on a workpile avoid a dynamic disturbance zone that forms on the workpile surface due to the releasing of material through an opening at the worksite. By scanning the workpile surface, an up-to-date definition of the zone may be maintained as the workpile height changes due to material ingress, egress, and/or movement about the worksite. Additionally, the vehicles may be continually apprised the zone and/or alerted when they travel too close to, or into, the zone. Thus, vehicles may be prevented from moving too close to, or into the zone.

Further, the disclosed terrain mapping and avoidance system may identify the zone in situations where the zone cannot be easily detected from an examination of the workpile surface alone, such as when the slope of the workpile surface in or near the zone is relatively horizontal (i.e., when the zone is inconspicuous). By using the angle of repose of the material, the known location of the opening, and the points defining the scanned workpile surface, the zone may be identified without analyzing the contours of the workpile surface.

Those skilled in the art will also appreciate that processes illustrated in this description may embody one or more computer programs stored on and/or read from computer-readable storage media. For example, worksite computing system 44 and/or onboard system 110 may include a computer-readable storage medium having stored thereon computer-executable instructions which, when executed by a computer, cause the computer to perform, among other things, the processes disclosed herein. Exemplary computer readable storage media may include secondary storage devices, like hard disks, floppy disks, CD-ROM, DVD-ROM, flash drives, optical storage devices, solid state storage devices, and/or other forms of computer-readable storage media.

It will be apparent to those skilled in the art that various modifications and variations can be made to the method and system of the present disclosure. For example, in other embodiments, vehicle controller 124 may perform one or more of the processes discussed above as being performed by worksite avoidance system controller 50, and vice versa.

For example, onboard system 110 of vehicle 38 may alternatively or additionally perform the functions worksite computing system 44. Signals from sensors 42 may be communicated directly to vehicle controller 124 (instead or in addition to worksite avoidance system controller 50), and vehicle controller 124 may perform one or more of the processes discussed above as being performed above by worksite avoidance system controller 50. In this manner, vehicle controller 124 may independently identify zone 32, determine the location of vehicle 38 relative to zone 32, and perform one or more of the actions discussed above in response thereto.

Other embodiments of the disclosed methods and systems will be apparent to those skilled in the art upon consideration of the specification and practice of the disclosure. It is intended that the specification be considered exemplary only, with a true scope of the disclosure being indicated by the following claims and their equivalents.

What is claimed is:

1. A method of operating a vehicle on a pile of material on a worksite, the material being released through a drain opening beneath the pile at the worksite, comprising:

sensing, at a sensor, a surface of the pile;

identifying, at a controller, based on the sensed surface and a known location of the drain opening, a disturbance zone on the surface of the pile caused by the release of material;

transmitting, by the controller, a signal indicative of the disturbance zone to the vehicle; and controlling, by the controller, the vehicle to avoid the disturbance zone based on the signal.

2. The method of claim 1, further including determining a height of the pile based on the sensed surface, wherein identifying the disturbance zone includes determining a perimeter of the disturbance zone based on the location of the drain opening, an angle of repose of the material, and the height of the pile.

3. The method of claim 1, further including:

receiving a location of the vehicle; and determining whether the vehicle is located within a distance of the disturbance zone, wherein the signal is transmitted when it is determined that the vehicle is located within the distance of the disturbance zone.

4. The method of claim 1, further including at least one of halting operation of the vehicle and alerting an operator of the vehicle in response to the signal.

5. The method of claim 4, wherein the alert includes at least one of a visual alert and an audible alert.

6. The method of claim 1, further including displaying the pile, the disturbance zone, and the vehicle, to an operator of the vehicle based on the signal.

7. An avoidance system for operating a vehicle on a pile of material on a worksite, the material being released through a drain opening beneath the pile at the worksite and causing a disturbance zone to form on a surface of the pile, the system comprising:

a sensor positioned at the worksite and configured to sense the surface of the pile; and a processor in communication with the sensor and the vehicle, the processor being configured to:

identify the disturbance zone based on the sensed surface and a known location of the drain opening;

transmit a signal indicative of the disturbance zone to the vehicle; and control the vehicle to avoid the disturbance zone based on the signal.

8. The system of claim 7, wherein the processor is further configured to determine a height of the pile based on the sensed surface, wherein identifying the disturbance zone includes determining a perimeter of the disturbance zone based on the location of the drain opening, an angle of repose of the material, and the height of the pile.

9. The system of claim 7, wherein the processor is further configured to:

receive a location of the vehicle; and determine whether the vehicle is located within a distance of the disturbance zone, wherein the processor is configured to transmit the signal when it is determined that the vehicle is located within the distance of the disturbance zone.

10. The system of claim 7, wherein the vehicle includes a controller configured to halt operation of the vehicle or to alert a vehicle operator in response to the signal.

11. The system of claim 10, wherein the alert includes at least one of a visual alert and an audible alert.

12. The system of claim 7, wherein the vehicle includes a display device, the controller being configured to display the pile, the disturbance zone, and the vehicle on the display device based on the signal.

13. The system of claim 7, wherein the sensor includes a laser scanner.

14. A non-transitory computer-readable storage medium storing a computer program which, when executed by a computer, causes the computer to perform a method of operating a vehicle on a pile of material on a worksite, the material being released through a drain opening beneath the pile at the worksite, the method comprising:

sensing, at a sensor, a surface of the pile;

identifying, at a controller, based on the sensed surface and a known location of the drain opening, a disturbance zone on the surface of the pile caused by the release of material;

transmitting, by the controller, a signal indicative of the disturbance zone to the vehicle; and controlling, by the controller, the vehicle to avoid the disturbance zone based on the signal.

15. The computer-readable storage medium of claim 14, wherein the method further includes:

determining a height of the pile based on the sensed surface, wherein identifying the disturbance zone includes determining a perimeter of the disturbance zone based on the location of the drain opening, an angle of repose of the material, and the height of the pile.

16. The computer-readable storage medium of claim 14, wherein the method further includes:

receiving a location of the vehicle; and determining whether the vehicle is located within a distance of the disturbance zone, wherein the signal is transmitted when it is determined that the vehicle is located within the distance of the disturbance zone.

17. A vehicle operating on a pile of material on a worksite, the material being released through a drain opening beneath the pile at the worksite, the vehicle comprising:

a communication device configured to receive a signal indicative of a sensed surface of the pile;

a positioning device configured to determine a location of the vehicle on the worksite and to generate a signal indicative of the vehicle's location; and a controller in communication with the positioning device and the communication device, the controller being configured to:

identify, based on the sensed surface and a known location of the drain opening, a disturbance zone on the surface of the pile caused by the release of material;

determine whether the vehicle is located within a distance of the disturbance zone; and control the vehicle to avoid the disturbance zone based on the signal.

18. The vehicle of claim 17, further including an alert device in communication with the controller, wherein the controller is further configured to alert an operator of the vehicle via the alert device when it is determined that the vehicle is located within the distance of the disturbance zone.

19. The vehicle of claim 17, wherein the controller is further configured to halt operation of the vehicle when it is determined that the vehicle is located within the distance of the disturbance zone or control the vehicle to avoid the disturbance zone.

20. The vehicle of claim 17, further including a display device in communication with the controller, wherein the controller is configured to display the pile, the disturbance zone, and the vehicle on the display.

* * * * *